US008182550B1

(12) United States Patent
Hayes

(10) Patent No.: US 8,182,550 B1
(45) Date of Patent: May 22, 2012

(54) METHOD OF DYEING A WOVEN CARPET WITH YARNS OF DIFFERENT DYE AFFINITY

(75) Inventor: Paul C. Hayes, Dalton, GA (US)

(73) Assignee: Al Sorayai Trading & Industrial Group, Jeddah (SA)

( * ) Notice: Subject to any disclaimer, the term of this patent is extended or adjusted under 35 U.S.C. 154(b) by 0 days.

(21) Appl. No.: 13/107,245

(22) Filed: May 13, 2011

(51) Int. Cl.
*C11D 3/00* (2006.01)

(52) U.S. Cl. ..... 8/115.51; 8/115.6; 8/115.7

(58) Field of Classification Search ..... 8/115.51, 8/115.6, 115.7
See application file for complete search history.

(56) References Cited

U.S. PATENT DOCUMENTS

2008/0016625 A1* 1/2008 Rao ..... 8/115.51
* cited by examiner

*Primary Examiner* — Eisa Elhilo
(74) *Attorney, Agent, or Firm* — Holland & Knight LLP; Brian J. Colandreo, Esq.; Rory E. Foster, Esq.

(57) ABSTRACT

A method of applying color to a woven carpet product includes positioning a woven carpet within a dyeing system. The woven carpet includes at least two types of yarn configured to retain a dye. At least one of the two types of yarn has a first dye affinity and another of the two types of yarn has a second dye affinity. A dye is applied to the at least two types of yarn included within the woven carpet via the dyeing system.

21 Claims, 2 Drawing Sheets

METHOD OF DYEING A WOVEN CARPET WITH YARNS OF DIFFERENT DYE AFFINITY

TECHNICAL FIELD

This disclosure relates to dyeing carpets and, more particularly, dyeing woven carpets using a plurality of dyes.

BACKGROUND

Within the carpet industry, there is great demand for carpets displaying complex patterns and originality. Further, customers may be interested in obtaining rugs that are different from those they have seen before. In response to this demand, carpet producers utilize various design and manufacturing techniques to create original and aesthetically pleasing patterns. One method of creating desirable carpet is to utilize multiple colors in the carpet patterns, thus effecting an increase in the complexity and visual appeal of the carpet.

Certain aspects of known carpet looms, however, present an impediment to these goals. For example, the physical size of the creel required for bobbins of different colors of yarn imposes a limit on the number of colors that a finished woven carpet may display.

SUMMARY OF DISCLOSURE

According to an aspect of the disclosure, a method of producing a woven carpet product includes positioning a woven carpet within a dyeing system. The woven carpet includes at least two types of yarn configured to retain a dye, wherein at least one of the two types of yarn has a first dye affinity and another of the two types of yarn has a second dye affinity. The dye is applied to the at least two types of yarn included within the woven carpet via the dyeing system.

One or more of the following features may be included. Applying the dye to the at least two types of yarn may include applying at least two different colors of dye to the at least two types of yarn included within the woven carpet. The woven carpet may be woven on at least one of the group consisting of a Wilton loom, an Axminster loom and a wide loom. The woven carpet may be configured to be cut into carpet tiles. The woven carpet may include at least a third type of yarn that is configured to not retain the applied dye. The woven carpet may be at least partially constructed from a yarn including one or more of a nylon, a wool, a wool-blend, a polypropylene, or a polyester. The applied dye may include at least one of an acidic dye and a basic dye. The dyeing system may include a dye printing system. The dye printing system may include at least one of a jet-type printing system or a rotary-type printing system.

According to another aspect of the disclosure, a method of producing a woven carpet product includes positioning a woven carpet within a dyeing system. The woven carpet includes at least two types of yarn configured to retain a dye, wherein at least one of the two types of yarn has a first dye affinity and another of the two types of yarn has a second dye affinity. The dye is applied to the at least two types of yarn included within the woven carpet via the dyeing system. Applying the dye to the at least two types of yarn includes applying at least two different colors of dye to the at least two types of yarn included within the woven carpet. The woven carpet is woven on at least one of the group consisting of a Wilton loom, an Axminster loom and a wide loom.

One or more of the following features may be included. The woven carpet may include at least a third type of yarn that is configured to not retain the applied dye. The woven carpet may be at least partially constructed from a yarn including one or more of a nylon, a wool, a wool-blend, a polypropylene, or a polyester. The applied dye may include at least one of an acidic dye and a basic dye. The dyeing system may include a dye printing system. The dye printing system may include at least one of a jet-type printing system or a rotary-type printing system.

According to another aspect of the disclosure, a method of producing a woven carpet product includes positioning a woven carpet within a dyeing system. The woven carpet includes at least two types of yarn configured to retain a dye, wherein at least one of the two types of yarn has a first dye affinity and another of the two types of yarn has a second dye affinity. The dye is applied to the at least two types of yarn included within the woven carpet via the dyeing system. The woven carpet is at least partially constructed from a yarn including one or more of a nylon, a wool, a wool-blend, a polypropylene, or a polyester. The woven carpet includes at least a third type of yarn that is configured to not retain the applied dye.

One or more of the following features may be included. Applying the dye to the at least two types of yarn may include applying at least two different colors of dye to the at least two types of yarn included within the woven carpet. The woven carpet may be woven on at least one of the group consisting of a Wilton loom, an Axminster loom and a wide loom. The applied dye may include at least one of an acidic dye and a basic dye. The dyeing system may include a dye printing system. The dye printing system may include at least one of a jet-type printing system or a rotary-type printing system.

The details of one or more implementations are set forth in the accompanying drawings and the description below. Other features and advantages will become apparent from the description, the drawings, and the claims.

BRIEF DESCRIPTION OF THE DRAWINGS

Like reference symbols in the various drawings indicate like elements.

DETAILED DESCRIPTION OF THE PREFERRED EMBODIMENTS

Traditionally, color was applied to woven carpets only through the use of pre-dyed yarns. Looms used to produce woven carpets include a mechanism called a creel, which serves as a yarn loading and delivery vehicle or device. The creel typically contains multiple bobbins, with the number of bobbins depending in part on the type of loom employed. In order to create a woven carpet with a design incorporating multiple colors, multiple bobbins of yarn are loaded onto the creel of the loom, each bobbin containing a single color of pre-dyed yarn. As the carpet is weaved, the loom draws yarn from the creel, the yarn feeding from the multiple bobbins to be weaved into the carpet. As the yarn is weaved into the carpet, the design program or pattern dictates which of the various yarns, and, accordingly, which colors, will be visible in each portion of the woven carpet and which colors will be hidden from view.

In typical carpet weaving looms, for example Wilton or Axminster looms, the size of the creel creates a physical impediment to the use of more than a certain number of colored yarns. Accordingly, the number of colors which can used in any one woven carpet has traditionally been limited, with an equivalent limitation on the diversity of patterns that can be produced. Given consumers' desire for aesthetically pleasing carpets that are both complex and unique, this limitation on the number of colors of pre-dyed yarn that may be used, stemming itself from the physical size of the loom creel, represents a traditional limit on the ability of producers to exploit the marketplace.

Figure 1:
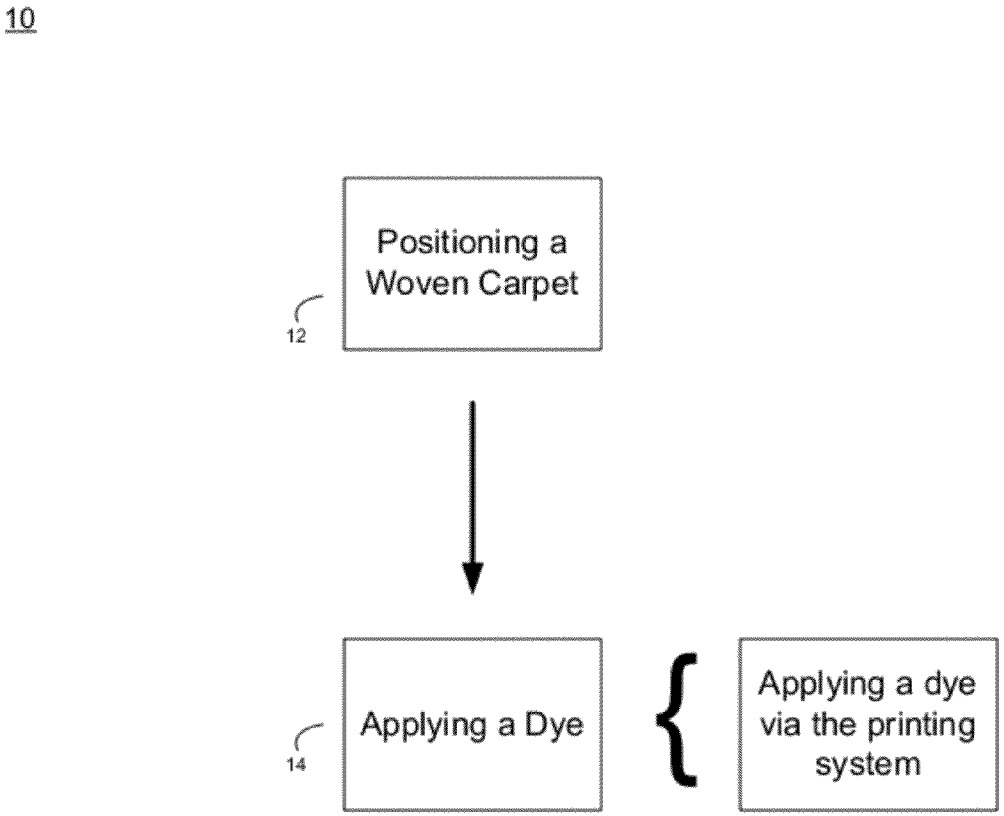
FIG. 1 is a flow chart view of an implementation of a method for dying woven carpet.
Figure 2:
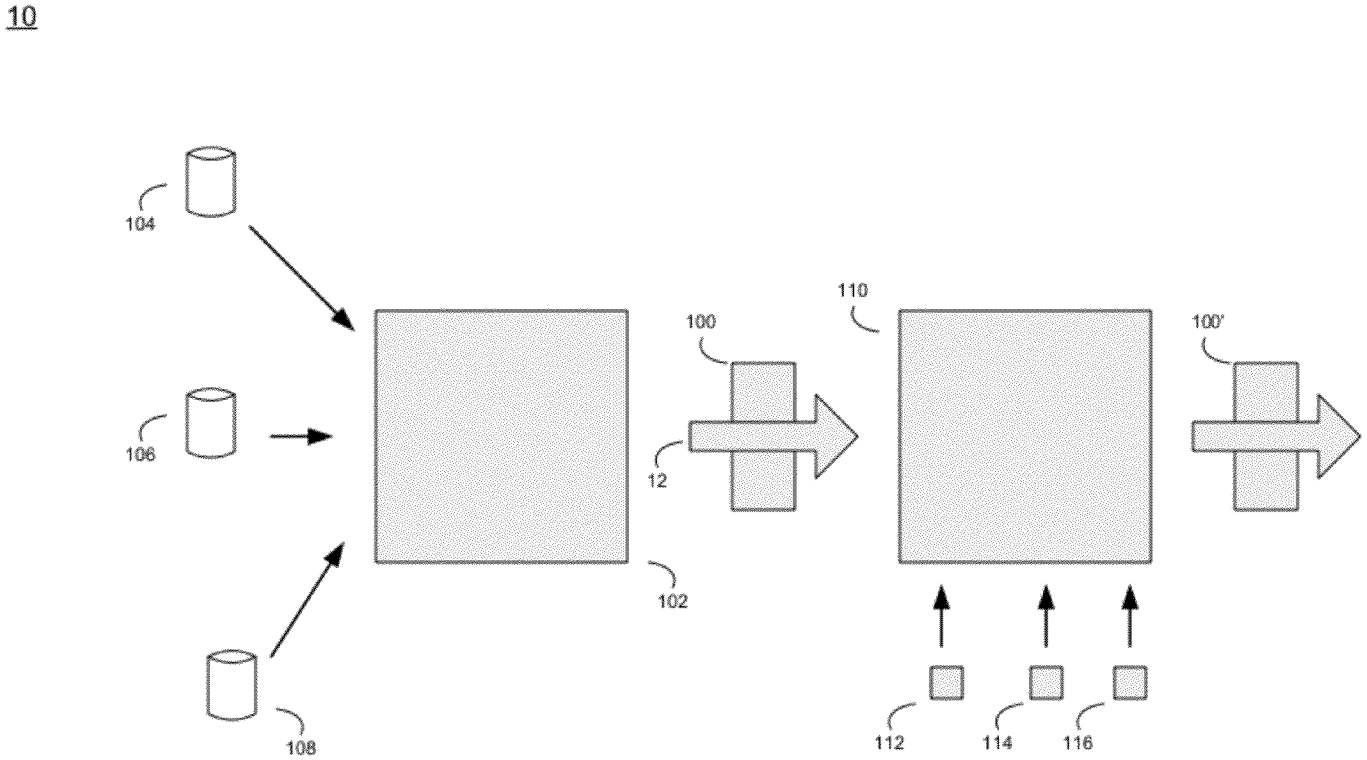
FIG. 2 is a diagrammatic view of an implementation of the method for dyeing woven carpet of FIG. 1.

Referring to FIGS. 1 & 2, there is shown one implementation of a method (i.e., method 10) of applying color to woven carpet 100. Woven carpet 100 may be woven on various types of looms (e.g., loom 102), examples of which may include but are not limited to a Wilton loom, an Axminster loom and a wide loom.

A Wilton loom is known in the art, the underlying concept having been known for at least two-hundred years. All carpet consists of an upper layer, or pile, which is attached to a backing material. On a Wilton loom, pile yarns of various colors run continuously in the carpet. The yarns are then lifted by mechanical means during the weaving process using, for example, wires or hooks. A particular pre-dyed yarn is lifted by these mechanical means only in positions at which the particular lifted color is intended to be seen as part of the overall carpet pattern. Because each pile yarn is contained in the back of the carpet and only lifted when its particular color is desired to be seen, Wilton woven carpets are often considered to have more body and resilience than other carpets. For this reason, Wilton woven carpets are often used in commercial areas that will be subject to high traffic, for example on airplanes, in office buildings and in hotels. Due, however, to the nature of the Wilton weaving process, in which the pile yarn runs continuously within the carpet, the manufacture of Wilton woven carpets can result in substantial waste.

Wilton looms can be found in various configurations. For example, Wilton carpets can be woven with cut pile, loop pile, or combination cut and loop pile construction. Various configurations of Wilton looms are known as plain or single-frame Wilton looms and Jacquard or multi-frame Wilton looms. In certain advanced configurations, carpets may be weaved in a face-to-face manner, sometimes referred to as "sandwich" production. In this "sandwich" configuration, the woven product is sliced through the center after weaving to create two carpets with nearly identical patterns. A "sandwich" configuration does not usually permit the construction of loop pile or cut and loop pile carpets. In Wilton loom carpets, because of the use of continuous yarn in the pile, typically only five colors of yarn may be loaded onto the creel for a single carpet. In many Wilton looms, only two to three colors are used in any design. Nevertheless the Wilton weaving process permits the creation of intricate patterns and styling.

An Axminster loom is also known in the art. In an Axminster loom, the machinery inserts yarn tufts into the pile from above, so that yarn strands do not need to run continuously along the pile as in a Wilton woven carpet. Accordingly, it may be possible to include more colors in the designs of an Axminster woven carpet than in a Wilton woven carpet. For example, many Axminster carpets are able to incorporate up to twelve different colors of yarn.

In an Axminster loom, typically a part of the carpet base is a jute weft and a part of the carpet base is a cotton warp. In carpet weaving, the weft is the portion of the carpet threads passing left to right on the loom while the warp is the portion of the carpet threads passing perpendicular to the warp. Yarn of various materials and colors is selected by a punched card mechanism known as a Jacquard, then drawn by a gripper from the yarn carrier. The selected yarn is cut into tufts, which are positioned by the gripper between the warp strands, allowing the tufts to then be retained by each pass of the weft. Because of the nature of the Axminster process, only cut loop carpets may be produced. Electronic Jacquards allow Axminster looms to create highly complex patterns and designs.

Axminster looms allow carpet to be weaved in various qualities. For example, a manufacturer may vary not only the design of an Axminster carpet, but also the number of rows per inch, the yarn count, or the pile height in order to customize the quality and cost of the woven carpet to the needs of a particular customer.

Looms may also be described by the width of the carpet produced. Typically, carpet looms produce carpets suitable for use as, for example, area rugs, i.e., carpets that are not intended to cover the entire floor of a particular room or area. However, it is possible to configure a loom to weave a carpet that is significantly broader than the usual configuration. By using a loom configured in this way, a "broad loom" or "wide loom," it is possible to construct seamless carpet that will cover the entire floor of a particular room or area. Broadloom carpets are often utilized in areas requiring noise absorption, such as sound-proof rooms or movie theaters, or in areas that would benefit from significant insulation. In addition to these uses, it is possible to create area or throw rugs on a broad loom by weaving a broadloom carpet with a continuous, varied or repeating pattern, then cutting the woven broadloom carpet into smaller sizes.

Woven carpet in general can be distinguished from tufted carpet, which is produced utilizing a fundamentally different technology. To create tufted carpet, needles are used to sew yarn into a primary backing material using a mechanism similar to that of modern sewing machines. Usually, then, a bonding adhesive is applied to the backing to further secure the yarns, and a secondary backing is placed below the primary backing. The backing may be either woven or non-woven material and the finished carpet may utilize loop pile, cut pile, or cut and loop pile. Tufted carpets account for the majority of carpet produced.

The woven carpet 100 may be at least partially constructed from a yarn including one or more of a nylon, a wool, a wool-blend, a polypropylene, or a polyester. Multiple yarns, for example yarn 104, yarn 106 and yarn 108, may also be included in the woven carpet 100. And certain of the multiple yarns, for example, yarn 104 and yarn 106 may include different materials than other of the multiple yarns, for example, yarn 108. The use of different types of yarn material can result in different characteristics of the finished woven carpet 100. For example, certain types of yarn may exhibit greater durability, or may be softer to the touch, or more lustrous in appearance. Additional characteristics of various types of yarn include flammability, the susceptibility of the yarn to soiling, staining and fading, and the tendency of the yarn to build up static electricity due to foot traffic. Further, the type of yarn used in the carpet may result in different overall cost of the woven carpet because of the different cost of the particular yarn types. Therefore, a particular type of yarn may be especially suitable for a particular application or consumer.

In general, yarn may be described by many characteristics. For example, a "denier" or "yarn denier" refers to the weight in grams of a single 9,000 meter filament or yarn bundle. For example 9,000 meters of 25 denier per filament (DPF) yarn would weigh 25 grams. DPF may also be expressed in terms of ply, such that 9,000 meters of 25/2-ply yarn would weigh 50 grams. Typically, yarn with greater denier is coarser, but more resilient and resistant to bending.

Yarn may also be characterized by twist, which is measured in turns per inch (TPI). Most yarns employed in carpets have 2.5 to 6.0 TPI, with yarn of higher TPI exhibiting better retention of texture and better overall resilience. Heat setting may sometimes be used to stabilize yarn twist, i.e., to prevent the yarn from untwisting. This is accomplished by exposing the yarn to pressurized steam.

Yarn may be constructed using several methods. One method of constructing yarn results in staple yarn. Another method of constructing yarn results in bulk continuous filament (BCF) yarn. Staple yarns are produced in segments of shorter lengths, then twisted or spun together to form longer threads. BCF yarns are produced by twisting together two or more continuous filaments into a single continuous strand.

Staple yarn may be further characterized by size, usually using the cotton count (cc) system which measures the number of 840 yard bundles, or hanks, in a pound of yarn. For example, six hanks of a 6 cc yarn (5040 yards) would weigh one pound, whereas three hanks of 3 cc yarn (2520 yards) would weigh the same.

Nylon yarns are widely used in carpet production due to its high wear-resistance, stain resistance, and overall resilience. Nylon yarn is resistant to both soiling and mildew, but can also tend to build up static due to foot traffic. For this reason, some nylon yarns may be treated with anti-static treatment. Nylon yarn may be produced in both staple and bulked continuous filament (BCF) varieties. Certain types of nylon yarn may be characterized as high tenacity yarn. High tenacity yarn may be designated as, for example, type PA6 or PA66.

Wool yarns are produced from natural wool fibers, for example British wool or New Zealand wool, with particular types of wool exhibiting distinctive properties of, for example, durability or receptivity to lighter shades of dye. Wool is often preferred for production of woven carpets do the richness of its look and feel, its resiliency, its resistance to staining and soiling, but is also expensive, often over twice the cost of certain synthetic yarns. Due partially to its expense, however, wool yarn is used infrequently in production of carpets. Wool is naturally a staple fiber and so is usually not found in the BCF variety.

Wool blend yarns include wool as well as a different material. The different material may include synthetic material, e.g., nylon or polyamide, and may also include natural material, e.g., silk. The inclusion of materials other than wool in a wool blend yarn allows the wool blend yarn to combine the benefits of both types of material. A wool/nylon blend, for example, combines the desired look and feel of wool yarn with the durability and lower cost of nylon yarns. Wool blend yarns may be constructed with a variety of different blend percentages. For example one wool blend yarn may include 40% wool and 60% nylon. A second wool blend yarn may include 60% wool and 40% nylon. A third wool blend yarn may include 30% wool, 30% nylon and 40% silk.

Polypropylene yarns withstand foot traffic well, but are not as resilient as many other types of yarn. Polypropylene is relatively inexpensive relative to other types of yarn and so can be an appropriate choice for lower cost woven carpet. Polypropylene yarn is also sometimes referred to as olefin and is strongly stain resistant. Polypropylene is typically solution-dyed, which means that color is added to the yarn while it is being extruded, rather than applied topically to the completed yarn, as may be typical with other types of yarns.

Polyester yarns are well regarded for color clarity and retention and can be extremely fade resistant while also offering superior stain resistance. Polyester yarn is typically manufactured in staple fiber only, and is available in a wide variety of textures. Polyester may also sometimes be manufactured from recycled plastic products. It is, however, susceptible to pilling and shredding and polyester pile can tend to flatten with foot traffic.

Still referring to FIGS. 1 & 2, method 10 may include positioning 12 woven carpet 100 within dyeing system 110. Woven carpet 100 may be constructed of a plurality of yarns that have different levels of dye affinity. As is known in the art, the dye affinity of a yarn is indicative of the ability of the yarn to absorb/retain/display the color of an applied dye. Specifically, the dye affinity of a particular yarn may be varied depending on the type of material used to construct the yarn, as well as the manner in which the yarn is manufactured and structured.

For example, a first yarn type, yarn 104, included within woven carpet 100 may have a first dye affinity that prevents yarn 104 from absorbing/retaining/displaying any level of dye color. Thus, if a vibrant red dye is applied to yarn 104, the original color of yarn 104 will not change and yarn 104 will not be dyed red.

However, a second yarn type, yarn 106, included within woven carpet 100 may have a second dye affinity that results in yarn 106 absorbing/retaining/displaying a very high level of dye color. Thus, if a vibrant red dye is applied to yarn 106, the original color of yarn 106 will change and yarn 106 will be dyed a vibrant red.

Further, a third yarn type, yarn 108, included within woven carpet 100 may have a third dye affinity that results in yarn 108 absorbing/retaining/displaying a moderate level of dye color. Thus, if a vibrant red dye is applied to yarn 108, the original color of yarn 108 will change and yarn 108 will be dyed a more subdued red.

The dye may be applied to the various types of yarn included within woven carpet 100 via dyeing system 110. For example, when applying dye 112 to the various types of yarn included within woven carpet 100, method 10 may apply different colors of dye to the different types of yarn included within woven carpet 100. For example, dyeing system 110 may include dye 112, dye 114, and dye 116. Dye 112 may be a red dye, dye 114 may be a blue dye, and dye 116 may be a green dye. Dye 112 may be applied to portions of yarn 104 and portions of yarn 106. Dye 114 may be applied to other portions of yarn 104 and other portions of yarn 106. Dye 116 may be applied only to yarn 108 or to portions of yarn 104 and yarn 106 to which neither dye 112 nor dye 114 has been applied.

The use of a plurality of yarns having different levels of dye affinity can result in a finished woven carpet 100' that exhibits a greater number of colors than is possible with traditional weaving methods. (Finished woven carpet 100' is woven carpet 100 after dye has been applied 14 to woven carpet 100 by dyeing system 110.) This is because when dye is applied 14 to woven carpet 100 which may include yarns of different levels of dye affinity, the result is a multiplication, in the finished carpet 100', of the number of shades of dye applied by the number of different levels of dye affinity represented in the yarns included in the woven carpet. For example, a single shade of red applied to three types of white yarn, each with a different dye affinity, may result in the appearance of three shades of red, one shade on each of the types of white yarn. As a further example, a red dye may be applied 14 to a portion of the three types of white yarn, each with a different dye affinity, and a blue dye may be applied 14 to another portion of the three types of white yarn, thereby resulting in the appearance of six shades of color—three shades of red and three shades of blue—from the application of only two colors of dye.

As another example, woven carpet 100 may be weaved on a loom using five bobbins of solution-dyed polypropylene yarn and three bobbins of white nylon yarns, one type being twisted heat-set nylon yarn, one type being BCF nylon, and one type being also twisted heat-set, but with a lower twist level and different filament count than the first type of twisted heat-set nylon yarn. Because the polypropylene yarn has been solution-dyed, it may be unable to absorb/retain/display dye which is subsequently applied topically, whereas the three types of white nylon yarn may each exhibit different a dye affinity because of the differences between their respective physical characteristics. Accordingly, when dye is applied 14 to the woven carpet 100, each of the three types of nylon yarn may absorb/retain/display the dye as a different color than the color displayed by each of the other three types of nylon yarn, resulting in the appearance on the finished woven carpet 100', after the application 14 of a single color of dye via the dyeing system 110, of three distinct colors, in addition to the five colors of the solution-dyed polypropylene yarns. It may further be possible to apply 14 more than one color of dye to woven carpet 100 in a predetermined pattern such that the application 14 of each color of dye to woven carpet 100 results in the appearance on finished woven carpet 100' of three distinct colors. In this way, finished woven carpet 100' may be caused to display a number of colors exceeding the number of yarn colors that may be physically included on the creel of the carpet loom.

The applied dye may include at least one of an acidic dye and a basic dye. For example, dye 112 may be an acidic dye and dye 116 may be a basic dye. As is known in the art, both acidic dyes and basic dyes are typically water soluble, although they may sometimes need to be converted to a salt form to obtain this property. Typically, acid dyes are anionic and may be applied to wool, nylon and acrylic fibers. Acid dyes typically lack affinity for cellulose fibers. Typically, basic dyes are cationic and are mainly applied to acrylic fibers, although they may also be applied to wool and other natural fibers. Acid dyes may tend to maintain their color under exposure to sunlight to a greater degree than do other types of dyes.

Dyeing system 110 may include a dye printing system, such as a jet-type printing system or a rotary-type printing system.

A jet-type printing system is well known in the art. This type of printer typically functions in a similar manner to an office ink jet printer. Jets are mounted on a printer head which is moveable, often in a single dimension, with respect to the carpet. Woven carpet 100 may be moved past the printer head, continuously and steadily, by well-known mechanisms, in a direction perpendicular to the movement of the printer head. The jets may be arranged in groups and are operated by computer control, which allows the jets to open and close with great rapidity. In certain jet-type printers, the jets can open and close up to 400 times per minute. Dye may be held in various pressurized dye reservoirs that communicate with the jets such that when the jets are opened the dye flows from the jets in a narrow stream. In this manner, dye may be injected into the pile of a carpet with great precision allowing patterns and designs to be printed onto woven carpet 100. Jet-type printers are typically controlled by computer, allowing the precise printing of complex designs.

Jet-type printers may be configured so that groups of jets inject the same color or so that individual jets inject individual and different colors. Use of the same color of dye in groups of jets can allow for faster printing, while use of individual colors in individual jets may allow for a greater number of colors. Multiple printer heads may also be employed. Use of multiple printer heads may allow for faster printing or for printing with greater number of colors. Certain types of jet-type printers, using multiple printer heads can print up to 32 different colors in a single design.

In a rotary-type printer, engraved screens are placed in a cylindrical configuration on cylindrical rollers, with a distinct screen and roller assembly being necessary for each color to be applied. Woven carpet 100 is caused to move over the screens using well known mechanical means and dye is applied 14, typically along the inner surface of the screen. The screen may allow the applied dye to pass through onto woven carpet 100 as it passes over the screen, with the excess dye being removed at the point of application by mechanical means. In this manner, dye may be applied 14 to the carpet only in the regions exposed to the holes in the screens and therefore only in the areas of the carpet in which the particular applied dye is desired. Through the use of adjacent screens with different patterns, complex designs of multiple colors may be applied 14 to woven carpet 100. Certain types of rotary-type printers can print up to 16 colors in a single design.

When applying 14 a dye to woven carpet 100, at least two different colors of dye, for example dye 112 and dye 114, may be applied 14 to woven carpet 100 via the printing system.

Various types of printing systems, including rotary-type printers and jet-type printers are capable of applying 14 more than one color of dye to a single carpet. As part of a carpet design, therefore, the printing system may be configured to apply 14 more than one color of dye to woven carpet 100. One color of dye may be applied only to certain regions of woven carpet 100 and those regions may include multiple types of yarn. Another color of dye may be applied only to certain other regions of woven carpet 100, specifically regions which do not receive an application of the first color of dye. The regions of woven carpet 100 receiving the application of the second color of dye may also include multiple types of yarn. In this manner, complex designs and patterns may be caused to appear on finished woven carpet 100'.

Further, through the use of different types of yarn, for example yarn 104, which may include a first material and have a first level of dye affinity, and yarn 106, which may include a second material and have a second level of dye affinity, an effective multiplication of the number of colors perceived on finished woven carpet 100' may be achieved. For example, yarn 104 may be a white nylon yarn with a first level of dye affinity and yarn 106 may be a white wool-blend yarn with a second level of dye affinity. When yarn 104 and yarn 106 are both weaved into a woven carpet 100 and a red dye, for example dye 112, and a blue dye, for example dye 114, are applied 14 to the carpet using the printing system, the result may be a carpet displaying four distinct colors. Where the red dye is applied 14 to the white yarns, each white yarn may display a distinct color of red, with the red displayed by yarn 104 being different from the red displayed by the yarn 106. And where the blue dye is applied to the white yarns, each white yarn may display a distinct color of blue, with the blue displayed by the yarn 104 being different from the blue displayed by the yarn 106.

As a further example, yarn 108 may be a solution-dyed yarn, such as solution-dyed polypropylene, and may be included woven carpet 100 in addition to yarn 104, a type of white nylon yarn with a first level of dye affinity, and yarn 106, a type of white wool-blend yarn with a second level of dye affinity. Dye 112 may be a red dye, for example, and dye 114 may be a blue dye, for example, whereby application 14 of dye 112 and dye 114 to woven carpet 100 by the printing system may result in finished woven carpet 100' displaying five distinct colors. The solution-dyed yarn, yarn 108, because it does not absorb/retain/display the dye applied by the printer, may display only the color with which it was solution-dyed. And each type of white yarn, yarn 112 and yarn 114, may display a distinct shade of red where the red dye was applied to the white yarn and a distinct shade of blue where the blue dye was applied to the white yarn, with the red and blue displayed by yarn 112 being different from the red and blue displayed by yarn 114.

Once dyed, the finished woven carpet 100' may, for example, be configured to be cut into carpet tiles. Although many consumers may desire carpets of large size, including carpets of a size that requires the carpets to be produced using a broad or wide loom, other customers may prefer tiles of carpet that may be easily positioned for installation and may be configured, without further cutting by the customer, to fit areas of particular geometry with great versatility. Carpet may be cut into tiles of various shapes, for example, squares, triangles, trapezoids, crescents, or other shapes. When cut into tiles, woven carpet may be easily packed and transported and may be installed in customizable configurations. Adhesive backing may sometimes be added to the carpet tiles to facilitate easy installation. Further, designs and patterns may be created so that arranging the tiles in various configurations creates variations of a smaller pattern or recreates the effect of a larger, continuous pattern.

A number of implementations have been described. Nevertheless, it will be understood that various modifications may be made. Accordingly, other implementations are within the scope of the following claims.

What is claimed is:

1. A method of applying color to a woven carpet product comprising:

positioning a woven carpet within a dyeing system, wherein the woven carpet includes at least two types of yarn configured to retain a dye, wherein at least one of the two types of yarn has a first dye affinity and another of the two types of yarn has a second dye affinity; and applying the dye to the at least two types of yarn included within the woven carpet via the dyeing system.

2. The method of claim 1 wherein applying the dye to the at least two types of yarn includes applying at least two different colors of dye to the at least two types of yarn included within the woven carpet.

3. The method of claim 1 wherein the woven carpet is woven on at least one of the group consisting of a Wilton loom, an Axminster loom and a wide loom.

4. The method of claim 1 wherein the woven carpet is configured to be cut into carpet tiles.

5. The method of claim 1 wherein the woven carpet includes at least a third type of yarn that is configured to not retain the applied dye.

6. The method of claim 1 wherein the woven carpet is at least partially constructed from a yarn including one or more of a nylon, a wool, a wool-blend, a polypropylene, or a polyester.

7. The method of claim 1 wherein the applied dye includes at least one of an acidic dye and a basic dye.

8. The method of claim 1 wherein the dyeing system includes a dye printing system.

9. The method of claim 8 wherein the dye printing system includes at least one of a jet-type printing system or a rotary-type printing system.

10. A method of applying color to a woven carpet product comprising:

positioning a woven carpet within a dyeing system, wherein the woven carpet includes at least two types of yarn configured to retain a dye, wherein at least one of the two types of yarn has a first dye affinity and another of the two types of yarn has a second dye affinity; and applying the dye to the at least two types of yarn included within the woven carpet via the dyeing system;

wherein applying the dye to the at least two types of yarn includes applying at least two different colors of dye to the at least two types of yarn included within the woven carpet; and wherein the woven carpet is woven on at least one of the group consisting of a Wilton loom, an Axminster loom and a wide loom.

11. The method of claim 10 wherein the woven carpet includes at least a third type of yarn that is configured to not retain the applied dye.

12. The method of claim 10 wherein the woven carpet is at least partially constructed from a yarn including one or more of a nylon, a wool, a wool-blend, a polypropylene, or a polyester.

13. The method of claim 10 wherein the applied dye includes at least one of an acidic dye and a basic dye.

14. The method of claim 10 wherein the dyeing system includes a dye printing system.

15. The method of claim 14 wherein the dye printing system includes at least one of a jet-type printing system or a rotary-type printing system.

16. A method of producing a woven carpet product comprising:

positioning a woven carpet within a dyeing system, wherein the woven carpet includes at least two types of yarn configured to retain a dye, wherein at least one of the two types of yarn has a first dye affinity and another of the two types of yarn has a second dye affinity; and applying the dye to the at least two types of yarn included within the woven carpet via the dyeing system;

wherein the woven carpet is at least partially constructed from a yarn including one or more of a nylon, a wool, a wool-blend, a polypropylene, or a polyester; and wherein the woven carpet includes at least a third type of yarn that is configured to not retain the applied dye.

17. The method of claim 16 wherein applying the dye to the at least two types of yarn includes applying at least two different colors of dye to the at least two types of yarn included within the woven carpet.

18. The method of claim 16 wherein the woven carpet is woven on at least one of the group consisting of a Wilton loom, an Axminster loom and a wide loom.

19. The method of claim 16 wherein the applied dye includes at least one of an acidic dye and a basic dye.

20. The method of claim 16 wherein the dyeing system includes a dye printing system.

21. The method of claim 20 wherein the dye printing system includes at least one of a jet-type printing system or a rotary-type printing system.

* * * * *